United States Patent [19]

Lowry

[11] 4,318,456

[45] Mar. 9, 1982

[54] TERMINAL SLOWDOWN CONTROL FOR ELEVATOR SYSTEM

[75] Inventor: James Lowry, Hicksville, N.Y.

[73] Assignee: Westinghouse Electric Corp., Pittsburgh, Pa.

[21] Appl. No.: 150,479

[22] Filed: May 16, 1980

[51] Int. Cl.[3] ..... B66B 5/06

[52] U.S. Cl. ..... 187/29 R

[58] Field of Search ..... 187/29

[56] References Cited

U.S. PATENT DOCUMENTS 3,779,346 12/1973 Winkler ..... 187/29
4,067,416 1/1978 Lowry ..... 187/29
4,128,141 12/1978 Caputo et al. ..... 187/29
4,161,236 7/1979 Husson ..... 187/29
4,225,015 9/1980 Yamada ..... 187/29

*Primary Examiner*—J. V. Truhe
*Assistant Examiner*—W. E. Duncanson, Jr.
*Attorney, Agent, or Firm*—D. R. Lackey

[57] ABSTRACT

An elevator system which initiates terminal slowdown in response to a comparison between a terminal slowdown speed pattern signal and the normal or desired speed pattern signal. The terminal slowdown speed pattern signal is generated in response to the actual position of the elevator car in a terminal zone adjacent to each terminal floor.

16 Claims, 4 Drawing Figures

FIG. IC
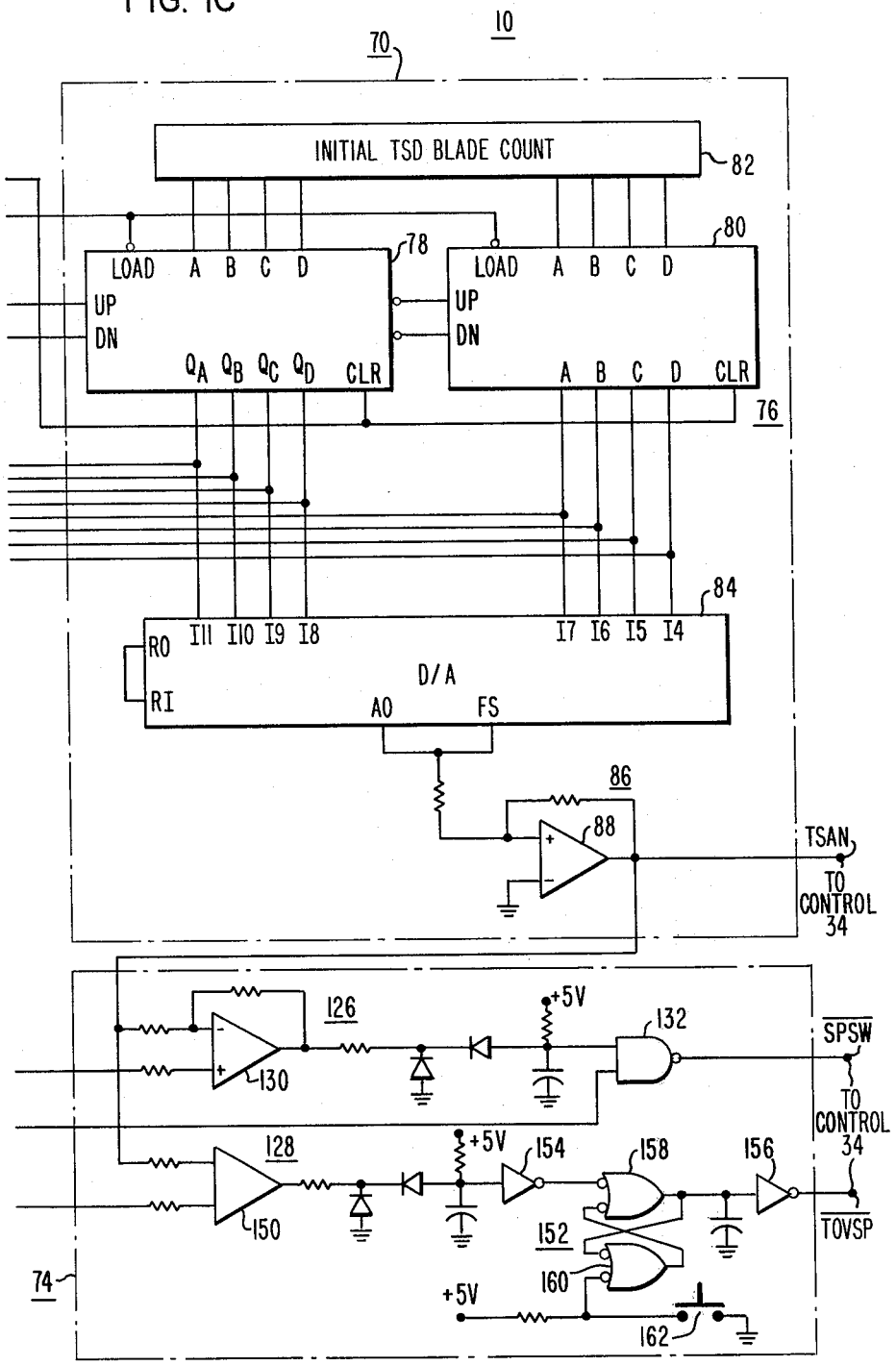

TERMINAL SLOWDOWN CONTROL FOR ELEVATOR SYSTEM

BACKGROUND OF THE INVENTION

1. Field of the Invention

The invention relates in general to elevator systems, and more specifically to new and improved terminal slowdown control for elevator systems.

2. Description of the Prior Art

It is necessary in elevator systems to provide independent means for detecting an overspeed condition of an elevator car as it approaches a terminal floor. In addition to the speed monitoring function, once an overspeed condition is detected, means must be provided for safely bringing the elevator car to a stop.

U.S. Pat. No. 3,779,346 which is assigned to the same assignee as the present application, discloses terminal slowdown control which includes spaced markers, such as a notched blade, and a detector. The markers and detector are mounted such that there is relative movement between them as the elevator car approaches a terminal floor. The notched blade is preferably mounted in the hatchway, and the detector is mounted on the elevator car such that it is aligned with the blade and will detect the spaced teeth on the blade as it passes them.

The markers or teeth on the blade are non-uniformly spaced, with the spacing being selected to provide the desired speed profile for bringing the elevator car to a stop at the terminal floor. The teeth are spaced successively closer together in the direction of the terminal such that the time required for the car to pass between any adjacent pair will be constant if the deceleration rate of the car is constant. If the time elapsed between adjacent pairs is shorter than a predetermined time, monitoring means, including means for converting the elapsed time to a speed error signal, will detect the overspeed condition and initiate slowdown, i.e., the switching from the normal speed pattern to an auxiliary speed pattern.

The spaced markers, and detector, along with means for converting the elapsed time between the spaced markers to a speed error signal, used for the monitoring function, are also used to generate the auxiliary speed pattern. The speed error signal is summed with a signal responsive to the speed of the elevator car, such as a signal from a tachometer responsive to the elevator drive motor, to provide the required slowdown speed pattern profile.

The notched or toothed blade in U.S. Pat. No. 3,779,346 provides a terminal slowdown signal responsive to car speed, and car speed error, and it is an exponential function of the distance of the elevator car to the terminal floor. While this arrangement provides an excellent terminal slowdown arrangement, the actual car speed must exceed the magnitude of the terminal slowdown speed pattern signal before the control switches from the normal speed pattern to the terminal slowdown speed pattern. Since there is about a 0.5 second delay in car response to the speed pattern, the stop under control of terminal slowdown is not always as accurate as desired.

Also, even under normal conditions, the actual speed of the elevator car may not exactly follow the desired speed pattern, and the tracking may be different from run to run. For example, as the elevator car drive machine heats up, or as the car load approaches maximum capacity, the elevator car speed may vary slightly with a consistent slowdown speed pattern. The car could make an acceptable slowdown and landing with this slight variation between speed pattern and actual car speed, but terminal slowdown may be activated. If the "speed error" between actual and desired speed required to initiate terminal slowdown is increased, to prevent nuisance or unnecessary activation of terminal slowdown, then the delay in switching to terminal slowdown, when it is actually necessary, becomes even longer. Finally, the notched blade is time consuming and therefore costly to manufacture because of the non-uniformly spaced teeth.

SUMMARY OF THE INVENTION

Briefly, the present invention is a new and improved elevator system in which the terminal slowdown speed pattern, when the elevator car is in a terminal zone, is strictly a function of car position. Transfer from normal speed pattern control to terminal slowdown speed pattern control is responsive to a comparison of these two speed patterns. If the normal or desired speed pattern exceeds the position-based terminal slowdown speed pattern, transfer is immediately made to the terminal slowdown speed pattern without waiting for the actual car speed to exceed the terminal slowdown speed pattern. Thus, the system has a faster response when terminal slowdown is actually required. Since activation of terminal slowdown is not responsive to actual car speed, nuisance or unnecessary activation of terminal slowdown due to normal deviations of actual car speed from the normal speed pattern is precluded. Further, unnecessary activation of terminal slowdown is not a problem, and since the normal speed pattern will not deviate appreciably from its proper value when it is functioning properly, the terminal slowdown speed pattern may be adjusted to be very close to the normal pattern, to detect malfunctions in the normal speed pattern even more quickly.

The fact that two speed patterns are compared in the monitoring function which initiates terminal slowdown, instead of comparing actual car speed with a speed pattern, is not felt to be a disadvantage. If the actual car speed is not properly following the normal speed pattern, it probably will not follow the terminal slowdown speed pattern either. The present invention provides a second level of control by comparing actual car speed with the terminal slowdown speed pattern, scaled to provide a signal when the speed error reaches a magnitude which requires an emergency stop. This signal is used to initiate the emergency stop function.

The present invention also enables continuous monitoring of the normal speed pattern in the terminal zones adjacent to the terminal floors, even when the elevator car is accelerating away from the associated terminal floor. This is important when the notched blade extends past one or more floors adjacent to the terminal floor, as it provides terminal slowdown protection should the elevator car leave the terminal floor, stop at an adjacent floor which is "on the blade", and then return to the terminal floor. The present invention also enables continuous monitoring of the normal speed pattern in the intermediate zone between the terminal zones, as the terminal slowdown speed pattern is set to the value that it should have at the start of the terminal zone, and this constant value is continuously maintained while the elevator car is in the intermediate zone. If the normal speed pattern should exceed the value of the terminal slowdown speed pattern in this intermediate zone, terminal slowdown will be initiated even through the elevator car is not then in a terminal zone. This will cause the elevator car to continue to run in its present direction, at a maximum speed determined by the terminal slowdown speed pattern, and upon entering a terminal zone it will then make a terminal slowdown and stop at the associated terminal floor.

Finally, the notched blade used in the preferred embodiment of the invention to aid in providing a terminal slowdown speed pattern which is a linear function of the car position relative to the terminal floor, is relatively easy to manufacture, and is universally applicable to all elevator installations, because the teeth or notches are all the same width, and they are all spaced by exactly the same dimension.

BRIEF DESCRIPTION OF THE DRAWINGS

The invention may be better understood, and further advantages and uses thereof more readily apparent, when considered in view of the following detailed description of exemplary embodiments, taken with the accompany drawings in which:

FIGS. 1A, 1B and 1C may be assembled to provide a schematic diagram of an elevator system constructed according to the teachings of the invention.

DESCRIPTION OF THE PREFERRED EMBODIMENT

Figure 1A:
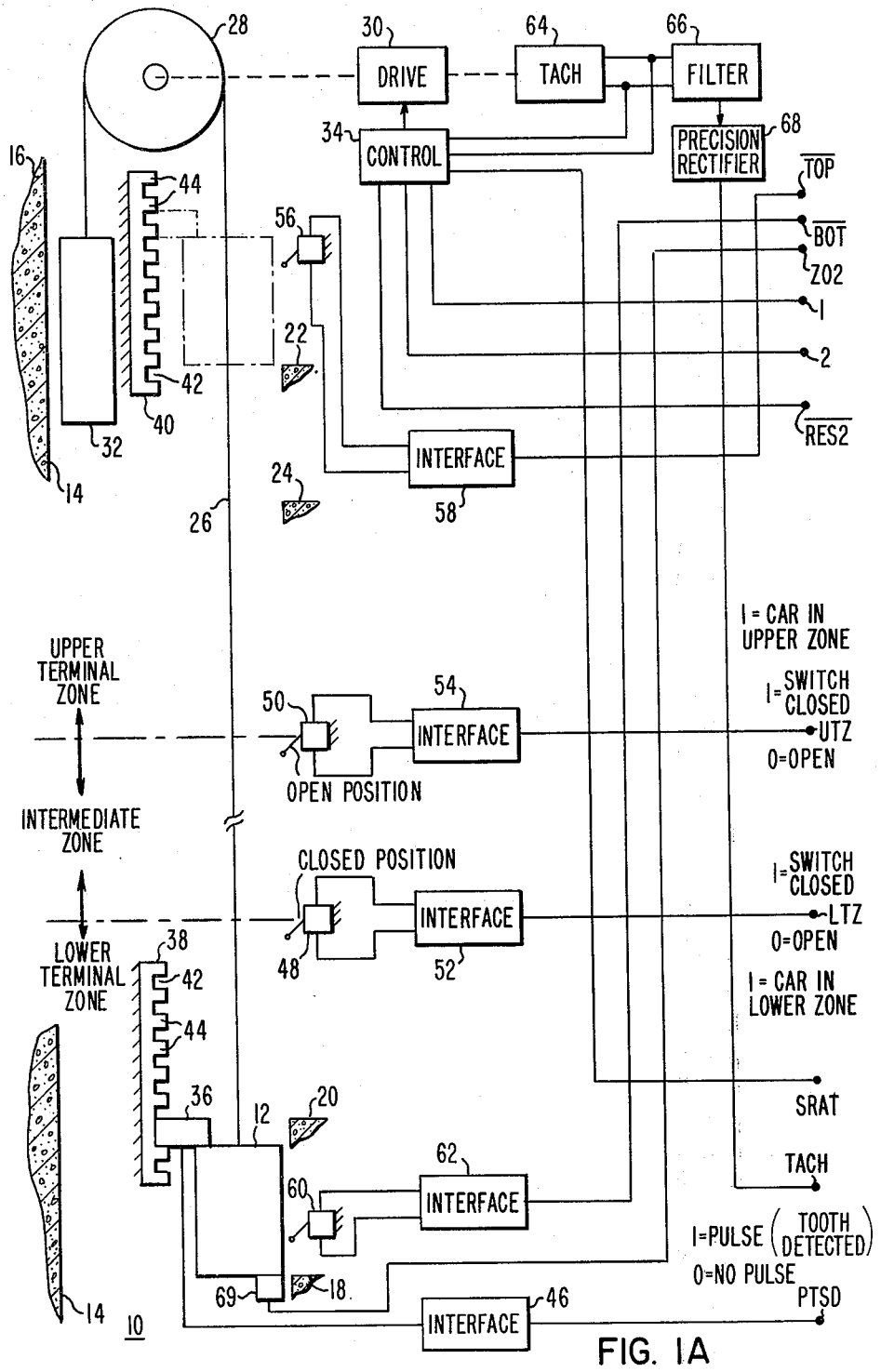
Figure 1B:
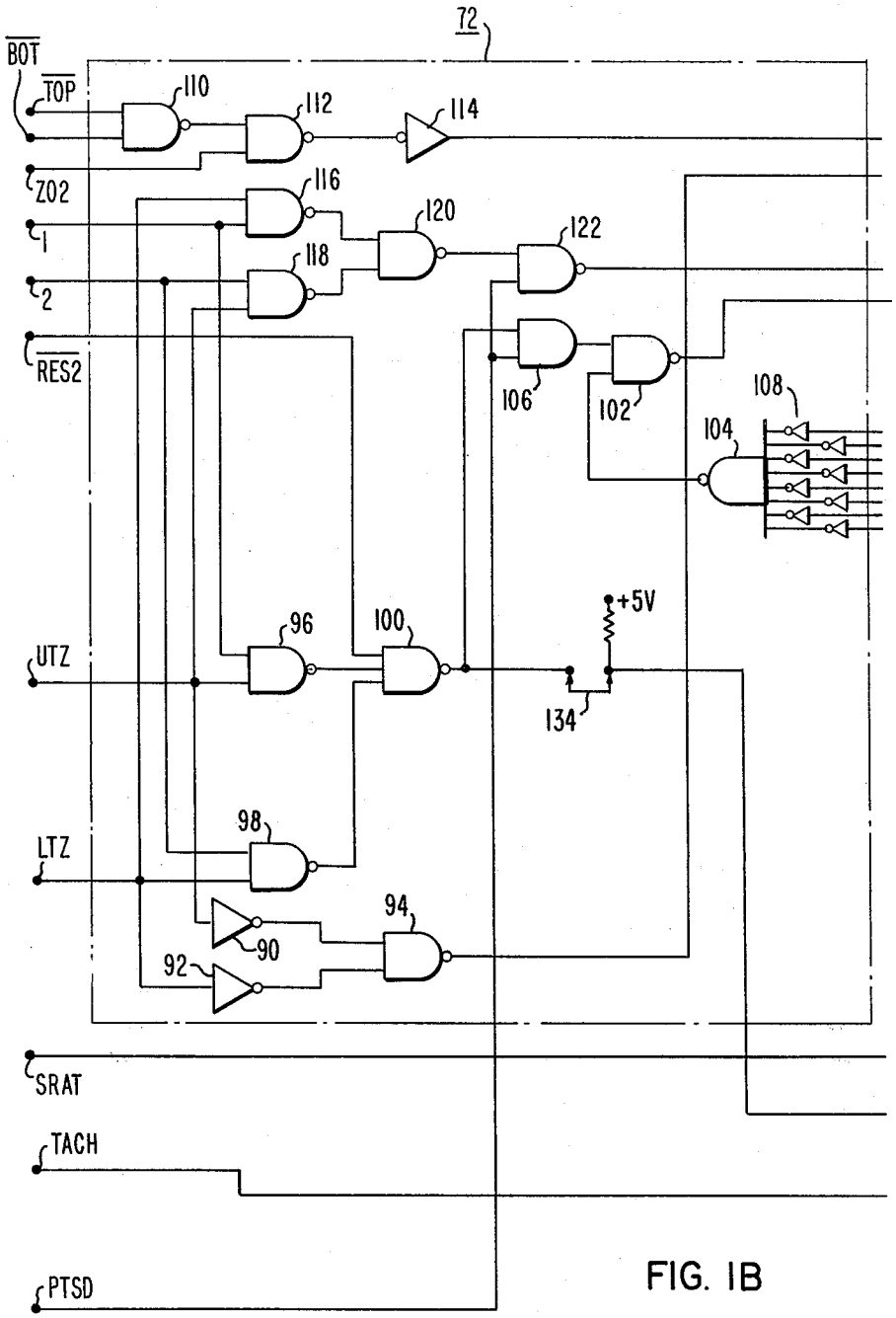

Referring now to the drawings, FIGS. 1A, 1B and 1C may be assembled to provide a schematic diagram of a new and improved elevator system 10 constructed according to the teachings of the invention. Elevator system 10 includes an elevator car 12 mounted in a hatchway 14 for movement relative to a structure 16 having a plurality of floors or landings. Only the lower terminal floor 18, its immediately adjacent floor 20, the upper terminal floor 22, and its immediately adjacent floor 24, are shown, in order to simplify the drawing. The elevator car 12 is supported by a plurality of wire ropes shown generally at 26, which are reeved over a traction sheave 28 mounted on the shaft of an elevator drive machine 30. A counterweight 32 is connected to the other end of the ropes 26. The control for operating the drive 30, including the motor controller, the normal speed pattern generator, which includes distance slowdown control for decelerating the elevator car into the target floor, and floor selector, is shown generally at 34. The hereinbefore-mentioned U.S. Pat. No. 3,779,346 may be referred to for details of such control, and this patent is hereby incorporated into the present application by reference.

The distance slowdown control portion of control 34 provides the normal speed pattern for decelerating and stopping the elevator car 12 at the terminal floors, as well as at the intermediate floors. The redundant and independent terminal slowdown control is provided by a combination of pick-up means and uniformly spaced marker means, which are arranged for relative movement as the elevator car 12 approaches a terminal floor. For purposes of example, it will be assumed that the pick-up means is mounted on the elevator car 12, with the pick-up means being indicated generally at 36, and that the spaced marker means is in the form of elongated plates or blades 38 and 40 disposed adjacent to the lower and upper terminal floors 18 and 22, respectively. The blades 38 and 40, in order to function as spaced markers, are provided with notches, holes, or other suitable openings 42, which in the preferred embodiment are formed by a plurality of spaced teeth 44. It is important to note that in the present invention the teeth 44 are uniformly spaced, and that the teeth 44 all have a like width dimension. The blades 38 and 40 are oriented such that the pick-up means 36 on the elevator car 12 can detect the spaced teeth as the car 12 approaches a terminal floor and to initiate signals which are changed into pulses PTSD by a suitable interface circuit 46. A logic one signal or pulse PTSD is generated each time a tooth is detected by detector means 36. The pick-up or detector means 36 may be of any suitable type, such as a photoelectric device, or a magnetic device which uses proximity detector principles, or transformer principles.

The hatchway or hoistway 14 is divided into zones to indicate: (a) when the elevator car 12 is physically located such that pick-up 36 is "on a terminal slowdown blade", which location will be referred to as a terminal zone, and (b) when the pick-up 36 is located between the lower and upper blades 38 and 40, which location will be referred to as an intermediate zone. For purposes of example, the zones are established by lower and upper hatch switches 48 and 50, respectively, which are fixed in the hatchway 14 adjacent to the start of blades 38 and 40, respectively. A cam on the elevator car 12 operates switch 48 to its closed position as the car approaches the lower terminal floor 18, with the cam being located such that switch 48 is closed just before pick-up means 36 detects the presence of the slowdown blade 38. The hatch switch 48 then remains closed until just after pick-up means 36 clears the slowdown blade 38 as the car 12 travels upwardly in the hatchway 14, away from the lower terminal floor 18.

In like manner, a cam on the car 12 operates switch 50 to its closed position as the elevator car 12 approaches the upper terminal floor 22, with the cam being located such that switch 50 is closed just before pick-up means 36 detects the slowdown blade 40. The hatch switch 50 then remains closed until just after pick-up means 36 clears the slowdown blade 40 as the elevator car 12 travels downwardly in the hatchway 14, away from the upper terminal floor 22.

Thus, when car 12 is located such that the pick-up means 36 is between the slowdown blades 38 and 40, the car is in an intermediate zone signified by the fact that both switches 48 and 50 are in their open positions. When either switch is closed, it signifies that the elevator car is located within a terminal zone. While mechanical hatch switches 48 and 50 are illustrated in FIG. 1A, it is to be understood that they may of any other suitable type, such as magnetic or inductor switches.

Switches 48 and 50 include power level-to-logic level interface circuits 52 and 54, respectively, which translate the switch position to a logic signal. For example, interface 52 provides a logic signal LTZ which is at the logic one level when switch 48 is closed, indicating the elevator car 12 is in the lower terminal zone. Signal LTZ is at the logic zero level when switch 48 is open, indicating that the elevator car 12 is not in the lower terminal zone. In like manner, interface 54 provides a logic signal UTZ which is at the logic one level when switch 50 is closed, indicating the elevator car 12 is in the upper terminal zone. Signal UTZ is at the logic zero level when switch 50 is open, indicating that the elevator car 12 is not in the upper terminal zone.

Additional signals used by the invention, and readily available in most elevator systems, are the signals $\overline{TOP}$, $\overline{BOT}$, TACH, 1, 2, $\overline{RES2}$, SRAT, and ZO2. Signals $\overline{TOP}$ and $\overline{BOT}$, when true, i.e., a logic zero, indicate that the elevator car is within a predetermined short distance, such as 18 inches, from the upper and lower terminal floors 22 and 18, respectively. As indicated in FIG. 1A, signals $\overline{TOP}$ and $\overline{BOT}$ may be provided by hatch switch 56 and interface 58, and hatch switch 60 and interface 62, respectively, with the hatch switches 56 and 60 being actuated by a suitable cam on the elevator car 12.

The signal TACH, is a unidirectional signal which indicates the actual speed of the elevator car 12. The signal TACH may be provided by a tachometer 64 driven by the drive motor of the drive machine 30, or by any other suitable device whose movement is proportional to car speed. The output of tachometer 64 is also used by the motor controller in control 34, in the speed versus pattern function which develops the error signal for controlling car speed. Since only the magnitude of the car speed is important in the present invention, the output of tachometer 64 is applied to a scaled absolute value amplifier which may include a filter 66 and a precision rectifier 68, such as is shown in detail in U.S. Pat. No. 4,161,236, which is assigned to the same assignee as the present application.

Signals 1 and 2 are provided by the travel direction selection circuits in control 34, with signal 1 being true, i.e., at the logic one level, when the elevator car is set for up travel, and with signal 2 being true when the elevator car is set for down travel. Travel direction circuits having suitable up and down travel relays which may initiate signals 1 and 2 are shown in detail in U.S. Pat. No. 4,042,068, for example, which is assigned to the same assignee as the present application.

Signal $\overline{RES2}$ is provided by control 34 when power is initially applied to the control circuits during the start-up procedure, and the elevator car is not located at a terminal floor where its selector may be reset. Signal $\overline{RES2}$, when it goes low, initiates a control sequence which will move the car 12 to the lower terminal floor 18, to reset its floor selector. My U.S. Pat. No. 4,067,416 illustrates reset circuitry which may be used.

Signal SRAT is the normal speed pattern signal provided by the speed pattern generator for the motor controller, with its development being shown in detail in the incorporated U.S. Pat. No. 3,779,346.

A true signal ZO2 is provided by landing control 69 when the elevator car is landing at a floor and it reaches a point 2 inches from floor level. Suitable landing control which is capable of providing signals ZO2 is shown in U.S. Pat. No. 4,019,606, which is assigned to the same assignee as the present application.

FIGS. 1B and 1C illustrate terminal slowdown apparatus constructed according to the teachings of the invention, which includes a terminal slowdown speed pattern generator 70 which provides a terminal slowdown pattern signal TSAN, logic or control 72 for controlling the terminal slowdown speed pattern generator 70, and monitoring means 74 which provides a true signal SPSW when the terminal slowdown speed pattern signal TSAN should be substituted for the normal speed pattern signal SRAT. Monitoring means 74 also provides a true signal TOVSP when an emergency stop should be initiated.

The terminal slowdown speed pattern generator 70 includes up/down counting means 76, such as first and second synchronous 4-bit up/down counters 78 and 80. Texas Instrument's SN74193 may be used, for example. The data inputs A, B, C, and D of counters 78 and 80 are connected to receive an initial count value from selectable logic level input means, shown generally at 82. The $Q_A$ through $Q_D$ outputs, which contain the instantaneous count value of the counting means 76, are connected to the digital data inputs of a digital-to-analog converter 84, such as Zeltex's ZD432. The analog output of the digital-to-analog converter 84 is amplified in suitable amplifier means 86, such as an amplifier which includes an operational amplifier 88, with the output of amplifier means 86 providing the terminal slowdown speed pattern signal TSAN.

The logic 72 for controlling the terminal slow-down speed pattern generator 70 controls the loading of the preset count from means 82 when the elevator car 12 is outside both terminal zones, it controls the clearing of the counting means 76 when the elevator car is located at a terminal floor, and it controls the counting direction of the counter in response to the pulses PTSD provided when the elevator car 12 is traveling in a terminal zone. The pulses PTSD are provided from the uniformly spaced slots and teeth of the blades 38 or 40. The initial blade count set in means 82 is the exact number of pulses which will be provided by detector 36 and interface 46 from the time a blade 38 or 40 is detected until the elevator car 12 is exactly at the level of the associated terminal floor. When the elevator car 12 is approaching a terminal floor in its associated terminal zone, the logic 72 causes the pulses PTSD to decrement the counter means 76. Thus, the magnitude of the terminal slowdown speed pattern signal TSAN is a linear function of the distance of the elevator car from the terminal floor. The pattern is at its maximum value when the blade is first detected, and it is zero when the elevator car is located precisely at the level of the terminal floor.

Since the blades 38 and 40 may extend past one or more floors located adjacent to a terminal floor, it would be possible for the car 12 to leave a terminal floor and travel to an adjacent floor without leaving the associated terminal zone. In order to provide reliable and accurate terminal slowdown protection should the elevator car then return to the terminal floor without leaving the terminal zone, i.e., without the detector 38 leaving the blade, logic 72 causes the pulses PTSD to increment counting means 76 when the elevator car is traveling in a terminal zone away from the associated terminal floor. Thus, the terminal slowdown speed pattern will always be at the proper magnitude for the position of the elevator car, should the elevator car return to the terminal floor without leaving the terminal zone.

More specifically, logic 72 includes inverter gates 90 and 92 and a NAND gate 94 for loading counter means 76 with the preset count of means 82 when the elevator car 12 is located outside of both terminal zones. Inverter gates 90 and 92 invert signals UTZ and LTZ, respectively, and they apply their outputs to the inputs of NAND gate 94. Thus, when the elevator car 12 is outside of both terminal zones, NAND gate 94 will have two logic one inputs, and its output, which is tied to the LOAD inputs of counters 78 and 80, will go low to load the preset count. Thus, the terminal slowdown speed pattern signal TSAN will be held at its maximum value until the elevator car enters a terminal zone. Entering either terminal zone releases the counters 78 and 80, and enables them to be decremented, or incremented, by the PTSD pulses, according to the counting direction selected by this portion of logic 72.

The count-down controlling logic includes NAND gates 96, 98, 100, 102 and 104, an AND gate 106, and eight inverter gates, identified collectively with the reference 108. NAND gate 100 will have all logic one inputs, blocking AND gate 106 from transmitting PTSD pulses, unless: (1) signal $\overline{RES2}$ goes low to cause the elevator car 12 to travel to the lower terminal floor 18 to reset its selector, or (2) the elevator car 12 is traveling up (signal 1 is a logic one), and the elevator car is in the upper terminal zone (signal UTZ is a logic one), or (3) the elevator car 12 is traveling down (signal 2 is a logic one), and the elevator car is in the lower terminal zone (signal UTZ is a logic one). If any of these three conditions exist, the counters 78 and 80 should be allowed to be decremented by pulses PTSD. Accordingly, any of these conditions will cause NAND gate 100 to output a logic one, and the logic one pulses PTSD will drive the output of NAND gate 106 high. The output of AND gate 106 is connected to one input of NAND gate 102, and the other input of NAND gate 102 is enabled by NAND gate 104 and inverters 108 until the counters 78 and 80 count down to zero, at which time the output of NAND gate 104 will go low and block NAND gate 102. While NAND gate 102 is enabled, each pulse PTSD drives the output of AND gate 106 high, and the output of NAND gate 102 low. The output of NAND gate 102 is connected to the "count-down" input of counter means 76, with the counter means decrementing its count each time the output of NAND gate 102 goes low.

When the elevator car reaches the target terminal floor, the counters 78 and 80 are forced to zero or "cleared" by NAND gates 110 and 112, and inverter gate 114. When the elevator car 12 reaches a point 18 inches from either terminal floor, either signal $\overline{TOP}$ or $\overline{BOT}$ will go low, and the output of NAND gate 110 will go high to enable NAND gate 112. When the elevator car continues into the terminal floor and reaches the 2-inch point, signal ZO2 will go high and the output of NAND gate 112 will go low. Inverter gate 114 then applies a logic one to the CLEAR inputs of counters 78 and 80.

The incrementing or "count-up" portion of logic 72 includes NAND gates 116, 118, 120 and 122. The output of NAND gate 120 will be low, blocking NAND gate 122 from transmitting PTSD pulses, unless: (1) the elevator car 12 is traveling up (signal 1 is a logic one) in the lower terminal zone (signal LTZ is a logic one), or (2) the elevator car 12 is traveling down (signal 2 is a logic one) in the upper terminal zone (signal UTZ is a logic one). In either of these conditions the counting means 76 should be free to count up. Accordingly, when these conditions occur, one input to NAND gate 120 will go low and its output will go high to enable NAND gate 122 to pass PTSD pulses. Each PTSD pulse drives the output of NAND gate 122 low, which increments counters 78 and 80, as the output of NAND gate 122 is connected to the "count-up" input of counting means 76.

The count-up feature is required when the elevator car 12 is capable of traveling from a terminal floor to an adjacent floor, and still be within the terminal zone, i.e., the detector 36 is still "on the blade". Should the elevator car 12 now be called upon the return to the terminal floor, it will have the exact count in counting means 76 required to provide the proper magnitude for signal TSAN, and thus always maintain proper terminal slowdown protection for the elevator system.

The monitoring means 74 includes first and second comparator means 126 and 128, respectively. The first comparator means 126 compares the normal speed pattern signal SRAT and the terminal slowdown speed pattern signal TSAN. If pattern SRAT exceeds pattern TSAN, a true or logic zero signal $\overline{SPSW}$ is generated which, as shown in the incorporated U.S. Pat. No. 3,779,346, initiates the transfer from the normal speed pattern to the terminal slowdown speed pattern TSAN. The first comparator means 126 may include an operational amplifier 130 and a NAND gate 132. NAND gate 132 has one input responsive to the output of operational amplifier 130, and the other input responsive to the output of NAND gate 100 via a jumper plug 134. It will first be assumed that the jumper plug 134 is removed, which enables NAND gate 132 continuously. If the elevator car 12 is located in the intermediate zone and signal SRAT exceeds signal TSAN, transfer to the terminal slowdown speed pattern TSAN will be made and the speed of the elevator car 12 will be controlled by the maximum value of this signal until entering a terminal zone. The speed of the elevator car will then be controlled by the decreasing value of TSAN, and the elevator car will land accurately at the associated terminal floor. If this continuous monitoring feature is not desired for some reason, i.e., if it is only desirable to initiate terminal slowdown when the elevator car is located in a terminal zone, insertion of the jumper plug 134 will block NAND gate 132 from providing a true $\overline{SPSW}$ signal unless: (1) the elevator car is in the $\overline{RES2}$ reset mode, or (2) the elevator car is traveling up in the upper terminal zone, or (3) the elevator car is traveling down in the lower terminal zone.

Figure 2:
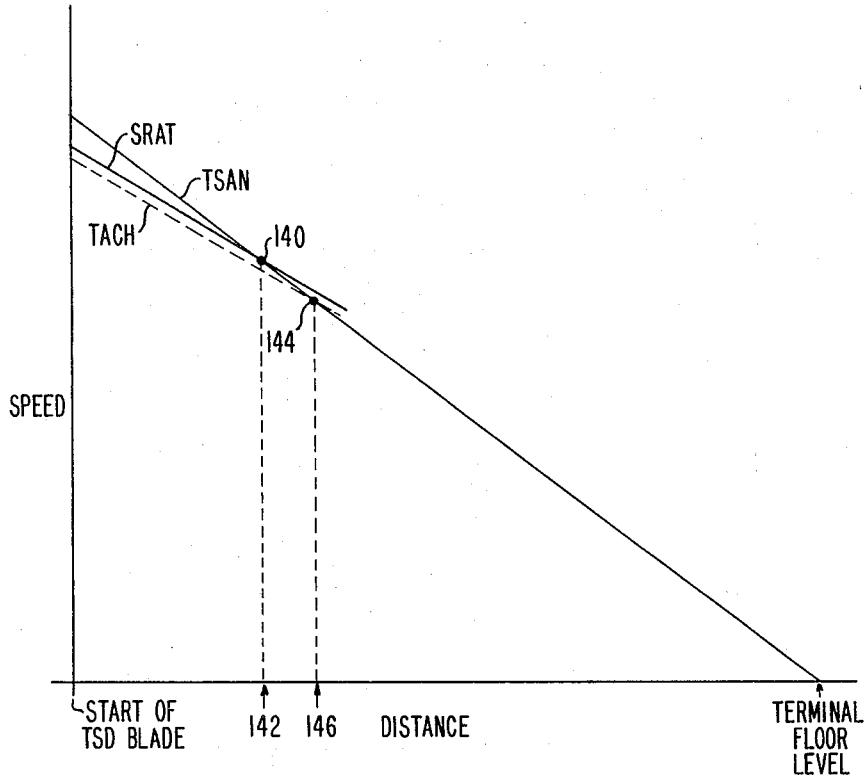
FIG. 2 is a graph which illustrates the faster response of terminal slowdown activation achievable by the present invention, compared with prior art arrangements.

The first comparator means 126 makes its decision based solely on the comparison of two speed pattern signals. Since the speed pattern signal SRAT is normally very stable, comparator 126 may be adjusted to provide a narrow margin between the two speed pattern signals without causing unnecessary or nuisance terminal slowdowns. For this reason, when a terminal slowdown stop is necessary, the need may be detected earlier than systems which use car speed in the comparison which initiates terminal slowdown. Also, since actual car speed lags the speed pattern when the pattern is changing, by about 0.5 second lag time, comparing the two speed patterns according to the teachings of the invention may gain this additional time in detecting the need for terminal slowdown. This advantage is illustrated in FIG. 2, which is a graph which plots speed versus distance to the terminal floor. In the example illustrated in FIG. 2, comparing patterns TSAN and SRAT provides an indication that terminal slowdown is required at the intersection point 140 of the two patterns, which intersection point occurs when the elevator car is a predetermined distance from the terminal floor, indicated at 142. If signal TSAN is compared with the actual car speed TACH, the intersection point occurs later, at point 144, at a distance 146 which is closer to the terminal floor than distance 142. Also, to prevent nuisance terminal slowdown actuation when comparing the actual car speed TACH and the speed pattern TSAN, curve TSAN would have to have a larger margin between it and the normal position of the signal TACH, so the point 144 would actually occur even closer to the terminal floor than indicated in FIG. 2.

It might seem that initiating terminal slowdown by comparing two speed patterns would be less reliable than comparing the actual speed of the elevator car with the terminal slowdown speed pattern signal TSAN. However, if the actual speed of the elevator car is not tracking the normal speed pattern properly, it may not track the terminal slowdown speed pattern either, and an emergency stop would have to be made. The present system compares the actual speed TACH and the terminal slowdown speed pattern signal TSAN in the second comparator 128, for the purpose of determining when an emergency stop is required. Thus, it is felt that the disclosed system is as reliable as prior art terminal slowdown systems, and it possesses the advantages of instituting terminal slowdown earlier than prior art systems, when it is required, with less chance of initiating terminal slowdown needlessly.

The second comparator 128 may include an operational amplifier 150, a memory, such as a flip-flop 152, and inverter gates 154 and 156. Flip-flop 152 may be formed of cross-coupled NAND gates 158 and 160. Flip-flop 152 may be reset by a push button 162 and a source of unidirectional potential, to cause NAND gate 158 to output a logic zero, which is inverted by inverter gate 156 to provide a high signal $\overline{\text{TOVSP}}$. If the actual car speed, represented by signal TACH is less than TSAN, operational amplifier 150 outputs a logic zero, which is inverted by inverter gate 154 to apply a logic one to flip-flop 152, and flip-flop 152 remains in its reset state. If the actual car speed TACH exceeds the pattern TSAN, as scaled by operational amplifier 150 and the input resistors, the output of operational amplifier 150 goes high and inverter gate 154 applies a logic zero to flip-flop 152 to cause it to switch to its set state. The now high output of NAND gate 156 is inverted by inverter 156 to provide a low or true signal $\overline{\text{TOVSP}}$. Signal $\overline{\text{TOVSP}}$ initiates an emergency stop by removing the drive power applied to sheave 28 by the drive machine 30, and by applying or dropping the brake on the drive machine, as is well known in the art. Since the elevator car 12 should not be automatically restarted after making an emergency stop, the flip-flop 152 holds the elevator car 12 in the emergency stop condition until the elevator system is checked by maintenance personnel, and flip-flop 152 is reset by depressing push button 162.

In summary, the initiation of terminal slowdown is independent of the speed of the elevator car. If the normal speed pattern SRAT exceeds the terminal slowdown pattern TSAN, which pattern is a linear function of the distance of the elevator car from the terminal floor, the car is transferred to the TSAN speed pattern. The distance to the terminal floor, in a preferred embodiment, is determined by a notched blade which is easy to manufacture because of the uniform tooth width, and the uniform spacing between the teeth. The comparison between the two speed patterns SRAT and TSAN allows for detection of a speed error by eliminating the car response time to a change in the speed pattern, and by being able to shave the margin between the two speed pattern signals without increasing the incidence of unnecessary or nuisance terminal slowdowns. An additional feature is the ability of the terminal slowdown system of the present invention to continuously monitor the speed pattern SRAT. The pattern SRAT may be continuously compared with the pattern TSAN during acceleration and deceleration adjacent to the terminal floors, and also at the constant or contract speed when it is outside of the terminal zones. Under this continuous monitoring feature, in the event that the pattern SRAT exceeds the pattern TSAN at any place in the hatch, transfer is immediately made to the TSAN speed pattern. The elevator car will continue to run at a constant velocity determined by the maximum value of the TSAN speed pattern until a terminal blade is reached, and the pulses from the detector start to decrease the count in the up/down counters.

I claim as my invention:

1. An elevator system, comprising:

a structure having a hatchway and a plurality of landings, including terminal landings, an elevator car mounted for movement in said hatchway, a plurality of uniformly spaced marker means, detector means, said spaced marker means and said detector means being mounted for relative movement in response to movement of the elevator car as it approaches a terminal landing, first speed pattern means responsive to said detector means, said first speed pattern means providing a terminal slowdown speed pattern signal as a function of car position relative to a terminal floor, second speed pattern means providing a desired speed pattern signal, means providing a signal responsive to the actual speed of the elevator car, control means controlling the speed of the elevator car in response to said desired speed pattern signal and said actual speed signal, and comparator means responsive to said terminal slowdown speed pattern signal and said desired speed pattern signal, and providing a predetermined signal when a predetermined relationship exists between them which causes said control means to control the speed of the elevator car in response to said terminal slowdown speed pattern signal.

2. The elevator system of claim 1 including second comparator means comparing the signal responsive to the actual speed of the elevator car with the terminal slowdown speed pattern signal, and providing a signal for the control means when they have a predetermined relationship.

3. The elevator system of claim 1 wherein the marker means includes spaced marker means disposed in the hatchway adjacent to each terminal floor, which define upper and lower terminal zones, and the first speed pattern means includes counter means, means responsive to the elevator car being outside of both the upper and lower terminal zones for loading said counter means with a predetermined count, means decrementing said predetermined count in response to the spaced marker means as the elevator car enters a terminal zone and proceeds towards the associated terminal floor, and means responsive to the magnitude of the count for providing the terminal slowdown speed pattern signal.

4. The elevator system of claim 3 including means incrementing the count of the counter means in response to the spaced marker means when the elevator car is in a terminal zone and traveling away from the associated terminal floor.

5. The elevator system of claim 3 wherein the first speed pattern means provides the terminal slowdown speed pattern signal in response to the predetermined count on the counter means when the elevator car is outside of both terminal zones, and the comparator means continuously compares the terminal slowdown speed pattern signal and the desired speed pattern signal when the elevator car is within a terminal zone, and when the elevator car is outside both terminal zones, with the comparator means providing the predetermined signal when the desired speed pattern signal exceeds the terminal slowdown speed pattern signal to cause the control means to control the speed of the elevator car in response to the terminal slowdown speed pattern signal and the actual car speed signal, regardless of the position of the elevator car in the hatchway.

6. The elevator system of claim 1 wherein the spaced marker means includes a notched blade member disposed adjacent to each terminal floor, having a predetermined number of teeth having like width dimensions, and with a like spacing between adjacent teeth.

7. The elevator system of claim 1 wherein the spaced marker means includes an elongated member disposed adjacent to each terminal floor, with said elongated members defining terminal zones adjacent to their associated terminal floors, and an intermediate zone therebetween, said elongated members each having uniformly spaced marker means which cooperate with the detector means such that the detector means provides pulses as the elevator car traverses a terminal zone, and the first speed pattern means includes counter means, means for loading said counter means with a predetermined count when the elevator car is in the intermediate zone, means for decrementing the count in response to the pulses from the detector means as the elevator car traverses a terminal zone towards the associated terminal floor, and means providing the terminal slowdown speed pattern signal in response to the magnitude of the count on said counter means.

8. The elevator system of claim 7 including means incrementing the count on the counter means in response to pulses from the detector means as the elevator car traverses a terminal zone away from the associated terminal floor.

9. An elevator system, comprising:

a structure having a hatchway and a plurality of landings including terminal landings, means defining terminal zones adjacent to each terminal floor, and an intermediate zone therebetween, an elevator car mounted for movement in said hatchway, first speed pattern means providing a terminal slowdown speed pattern signal as a function of car position relative to a terminal floor when the elevator car is in a terminal zone, second speed pattern means providing a desired speed pattern signal, means providing a signal responsive to the actual speed of the elevator car.

comparator means responsive to said terminal slowdown speed pattern signal and said desired speed pattern signal, with said comparator means providing a signal indicative of their relative magnitudes, and control means controlling the speed of the elevator car in response to said desired speed pattern signal and said actual car speed signal when the signal from the comparator means indicates the desired speed pattern signal is less than the terminal slowdown speed pattern signal, and in response to the terminal slowdown speed pattern signal and said actual car speed signal when the desired speed pattern signal reaches the magnitude of the terminal slowdown speed pattern signal.

10. The elevator system of claim 9 including second comparator means comparing the signal responsive to the actual speed of the elevator car with the terminal slowdown speed pattern signal and providing a signal for the control means when they have a predetermined relationship.

11. The elevator system of claim 9 wherein the means defining the terminal zones adjacent to each terminal floor include uniformly spaced marker means, the first speed pattern means includes counter means, means responsive to the elevator car being outside of both the upper and lower terminal zones for loading said counter with a predetermined count, means decrementing said predetermined count in response to the spaced marker means as the elevator car enters a terminal zone and proceeds towards the associated terminal floor, and means responsive to the magnitude of the count for providing the terminal slowdown speed pattern signal.

12. The elevator system of claim 11 including means incrementing the count of the counter means in response to the spaced marker means when the elevator car is in a terminal zone and traveling away from the associated terminal floor.

13. The elevator system of claim 11 wherein the first speed pattern means provides the terminal slowdown speed pattern signal in response to the predetermined count on the counter means when the elevator car is outside of both terminal zones, and the comparator means continuously compares the terminal slowdown speed pattern signal and the desired speed pattern signal when the elevator car is within a terminal zone, and when the elevator car is outside of both terminal zones, with the comparator means providing the predetermined signal when the desired speed pattern signal exceeds the terminal slowdown speed pattern signal, to cause the control means to control the speed of the elevator car in response to the terminal slowdown speed pattern signal and the actual car speed signal, regardless of the position of the elevator car in the hatchway.

14. The elevator system of claim 9 wherein the spaced marker means includes a toothed blade member disposed adjacent to each terminal floor, having a predetermined number of teeth, with the teeth all having like width dimensions, and with a like spacing between adjacent teeth.

15. The elevator system of claim 9 wherein the means defining the terminal zones includes an elongated member disposed adjacent to each terminal floor, with said elongated members having uniformly spaced markers which cooperate with the detector means such that the detector means provides pulses as the elevator car traverses a terminal zone, and the first speed pattern means includes counter means, means for loading said counter means with a predetermined count when the elevator car is in the intermediate zone, means for decrementing the count in response to the pulses from the detector means as the elevator car traverses a terminal zone towards the associated terminal floor, and means providing the terminal slowdown speed pattern signal in response to the magnitude of the count on said counter means.

16. The elevator system of claim 15 including means incrementing the count on the counter means in response to pulses from the detector means as the elevator car traverses a terminal zone away from the associated terminal floor.

* * * * *